US007510048B2

(12) United States Patent
Nevill

(10) Patent No.: US 7,510,048 B2
(45) Date of Patent: Mar. 31, 2009

(54) DIAPHRAGMS FOR LOUDSPEAKER DRIVE UNITS

(75) Inventor: Stuart Michael Nevill, Kent (GB)

(73) Assignee: B&W Group Ltd, Worthing (GB)

( * ) Notice: Subject to any disclaimer, the term of this patent is extended or adjusted under 35 U.S.C. 154(b) by 165 days.

(21) Appl. No.: 10/560,777

(22) PCT Filed: Jun. 7, 2004

(86) PCT No.: PCT/GB2004/002406

§ 371 (c)(1),
(2), (4) Date: Dec. 14, 2005

(87) PCT Pub. No.: WO2004/114721

PCT Pub. Date: Dec. 29, 2004

(65) Prior Publication Data

US 2006/0137935 A1 Jun. 29, 2006

(30) Foreign Application Priority Data

Jun. 18, 2003 (GB) ..... 0314205.6

(51) Int. Cl.
*G10K 13/00* (2006.01)

(52) U.S. Cl. ..... 181/174

(58) Field of Classification Search ..... 181/174, 181/167, 173, 169; 381/423, 426, 428, 431, 381/430, 432

See application file for complete search history.

(56) References Cited

U.S. PATENT DOCUMENTS 3,153,463 A * 10/1964 Novak ..... 381/182
3,172,498 A * 3/1965 Gorike ..... 181/167
3,841,197 A * 10/1974 Morrisey ..... 89/1.816
4,076,098 A * 2/1978 Ward ..... 181/170
4,100,992 A * 7/1978 Rehde et al. ..... 181/166
4,252,211 A * 2/1981 Matsuda et al. ..... 381/401
4,359,132 A * 11/1982 Parker et al. ..... 181/169
4,395,597 A * 7/1983 Suzuki et al. ..... 181/170
4,410,768 A * 10/1983 Nakamura et al. ..... 381/423
4,478,309 A * 10/1984 Kawamura et al. ..... 181/167
4,517,416 A * 5/1985 Goossens ..... 381/431
4,562,899 A * 1/1986 Nakamura ..... 181/169
4,620,606 A * 11/1986 Suzuki ..... 181/170
4,635,750 A * 1/1987 Suzuki ..... 381/407
4,646,874 A * 3/1987 Baitcher et al. ..... 181/169
5,619,019 A * 4/1997 Yoshimura et al. ..... 181/166
5,689,093 A * 11/1997 Sun ..... 181/157
5,744,761 A * 4/1998 Ogura et al. ..... 181/167
5,847,333 A * 12/1998 D'Hoogh ..... 181/171

(Continued)

FOREIGN PATENT DOCUMENTS

GB 327776 4/1930

(Continued)

*Primary Examiner*—Walter Benson
*Assistant Examiner*—Forrest M Phillips
(74) *Attorney, Agent, or Firm*—Buchanan Ingersoll & Rooney PC

(57) ABSTRACT

A diaphragm for a loudspeaker drive unit (1), the diaphragm comprising a block of material having a first, sound-radiating front face (20) and a second, rear face (22). The block is stiffened by being bound about over the first and second faces (20,22) by a multiplicity of turns of one or more elongate members of flexible material (36) stiffened by a stiffening composition.

23 Claims, 3 Drawing Sheets

U.S. PATENT DOCUMENTS

Figure 1:
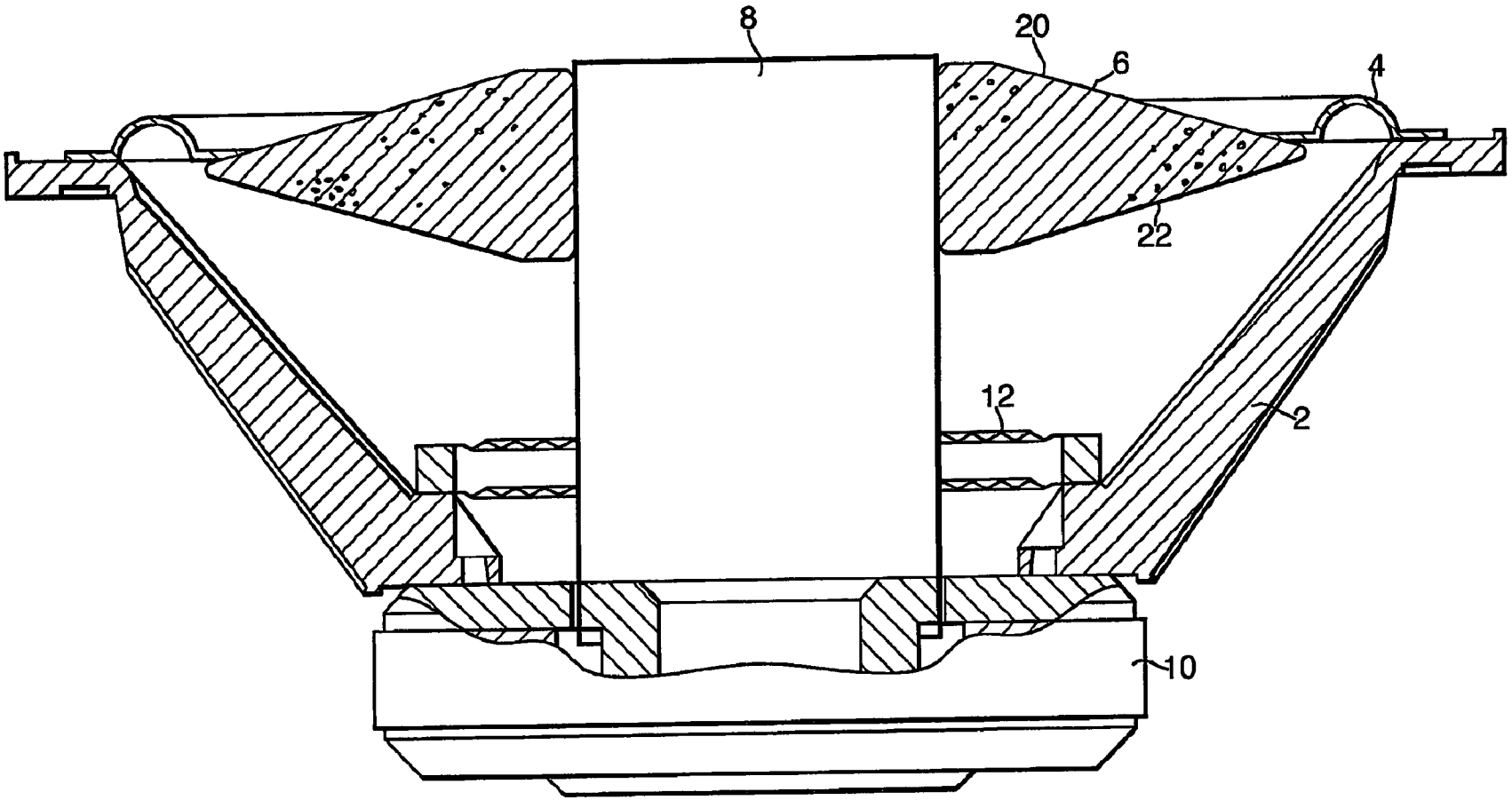

| | | | | |
|---|---|---|---|---|
| 6,039,146 | A * | 3/2000 | Byun et al. | 181/169 |
| 6,095,280 | A * | 8/2000 | Proni | 181/171 |
| 6,097,829 | A * | 8/2000 | Guenther et al. | 381/425 |
| 6,148,953 | A * | 11/2000 | Fujitani | 181/169 |
| 6,454,046 | B1 * | 9/2002 | Chuang | 181/167 |
| 6,740,202 | B2 * | 5/2004 | Ishigaki et al. | 162/218 |
| 6,845,169 | B2 * | 1/2005 | Ishigaki | 381/426 |
| 6,862,361 | B2 * | 3/2005 | James et al. | 381/423 |
| 7,120,263 | B2 * | 10/2006 | Azima et al. | 381/152 |
| 2001/0021678 | A1 * | 9/2001 | Pitsenberger et al. | 473/564 |
| 2002/0141607 | A1 * | 10/2002 | Azima et al. | 381/152 |
| 2002/0146145 | A1 * | 10/2002 | James et al. | 381/426 |
| 2003/0024763 | A1 * | 2/2003 | Hachiya et al. | 181/169 |
| 2004/0189151 | A1 * | 9/2004 | Athanas | 310/328 |
| 2005/0147274 | A1 * | 7/2005 | Azima et al. | 381/431 |
| 2005/0152577 | A1 * | 7/2005 | Nishimura et al. | 381/431 |
| 2006/0008111 | A1 * | 1/2006 | Nagaoka | 381/423 |
| 2006/0137935 | A1 * | 6/2006 | Nevill | 181/174 |
| 2006/0159293 | A1 * | 7/2006 | Azima et al. | 381/152 |
| 2007/0177758 | A1 * | 8/2007 | Ohara | 381/426 |

FOREIGN PATENT DOCUMENTS

| | | | |
|---|---|---|---|
| GB | 335329 | | 9/1930 |
| GB | 2 322 505 | A | 8/1998 |
| GB | 2403091 | A * | 12/2004 |
| JP | 59191998 | A * | 10/1984 |
| JP | 61009098 | A * | 1/1986 |
| JP | 04077096 | A * | 3/1992 |
| JP | 04092598 | A * | 3/1992 |
| WO | 00/78091 | A3 | 12/2000 |
| WO | WO0078091 | * | 12/2000 |

* cited by examiner

DIAPHRAGMS FOR LOUDSPEAKER DRIVE UNITS

This invention relates to diaphragms for loudspeaker drive units.

The construction of the diaphragm for a loudspeaker drive unit involves a number of inter-related and often conflicting criteria; in particular, the criteria of mass, stiffness, cost, and sound transmission though the diaphragm. In any given construction, these criteria must be carefully balanced to make a successful diaphragm; it is not generally possible to change any one of them in a given construction without upsetting the balance between them.

It is desirable to keep the mass of the diaphragm low to achieve good sensitivity but it is difficult to achieve a high degree of stiffness (which is desirable) with a diaphragm of low mass.

Patent Specification DE 10049744 discloses the use of polycrystalline diamond for making a diaphragm of high stiffness and low mass but the cost and the difficulty of fabrication preclude the use of diamond other than for very small diaphragms.

Patent specification WO 00/78091 describes a loudspeaker diaphragm made by winding tensile members about a frame and providing a membrane on the tensile members. A disadvantage of that construction is that the diaphragm is relatively transparent to sound passing through the diaphragm. It would not, however, be desirable to add significantly to the mass in attempting to reduce the sound transmission through the diaphragm.

It has also been proposed to make a loudspeaker diaphragm using a foam material, see, for example, patent specification GB 2,059,717. Foam has the advantage of being light and resistant to the transmission of sound but has the disadvantage of not having great stiffness. It would not, however, be desirable to add significantly to the mass in attempting to stiffen the diaphragm.

It is an object of the invention to provide a diaphragm for a loudspeaker drive unit which enables a good balance between the criteria of mass, stiffness, cost and sound transmission through the diaphragm to be achieved.

The present invention provides a diaphragm for a loudspeaker drive unit, the diaphragm comprising a block of material having a first, sound-radiating front face and a second, rear face, characterized in that the block is stiffened by being bound about over the first and second faces by a multiplicity of turns of one or more elongate members of flexible material stiffened by a stiffening composition.

Such an arrangement is able to provide a diaphragm of improved performance without the need for a high degree of tension in the binding and without the need for a skin on the outside of the binding. High tension in the binding may be used if desired and an outer skin may be provided if desired but it is preferred to use neither high tension nor an outer skin. The flexible nature of the material of the one or more elongate members makes it easy to wind about the block of material and the stiffening composition imparts stiffness to the wound material and to the diaphragm as a whole.

Such a construction is able to provide good isolation of the delayed resonances which can arise when the portion of the rear radiation of a loudspeaker diaphragm that is not absorbed by the speaker cabinet re-emerges through the diaphragm. That problem arises in conventional constructions because, typically, in a non-axisymmetric loudspeaker enclosure, the internal sound field is diffuse and sound impinging on the rear of a conventional thin diaphragm is subject only to modest attenuation above the intrinsically low natural modes and, at certain frequencies, the transmission loss may be lower still without adequate damping.

The use of a block of the material as a diaphragm improves stiffness whilst avoiding the complexity of a composite "sandwich" construction involving thin elements. A "sandwich" construction is problematic because the edges are difficult to deal with and, by its nature, the construction tends to be wasteful of materials.

Advantageously, the front face is convex. Such a construction avoids limitations of a simple conventional cone diaphragm, namely, that the concave side of a cone can have a deleterious effect on both on the acoustic output of the cone itself as a result of cavity and horn type effects, and also on the output of neighbouring diaphragms as a result of cavity absorption and strong reflection and re-radiation cancellation effects.

Advantageously, the second face is convex.

When the construction has two convex faces and is symmetrical, or at least approximately so, it overcomes the problem that a simple cone diaphragm is inherently asymmetric at a normal to its central axis. This asymmetry of a conventional construction results in nonlinear distortion owing to the difference in radiation resistance of the cone moving forward to the cone moving backwards and the difference in axial stiffness of the cone (loaded either by forcing acceleration or acoustic impedance) when the rim is being forced forwards or backwards.

The convex conical surfaces of the core may be straight sided or may be radiused or may follow a hyperbolic or exponential profile.

The convex conical surfaces may be non-circular.

The convex conical surfaces of the foam core may be different in height and profile.

Preferably, the or each face is frusto-conical.

The block may be circular in front elevation.

Instead, the block may be elliptical in front elevation.

The block may be made of a rigid plastics foam material. The term "rigid plastics foam material" is used to distinguish from soft plastics foam material having effectively no structural strength.

Ideally, the foam should have as low a density as possible. In practice, the foam may have a density of more than 20 grams per liter.

The foam may have a density between 28 and 35 grams per liter.

Advantageously, the foam is a polymethyl methacrylamide foam.

Instead, the foam may be expanded polystyrene.

In an illustrated embodiment of the invention, the foam diaphragm core is of a very low density, largely non-porous foamed material with a relatively high stiffness/mass ratio and high internal damping. Polymethyl methacrylamide foam with a density of 30 grams/liter is a suitable material, or, for a reduced cost, a moulded expanded Polystyrene foam form of density around 30 grams/liter will suffice.

Advantageously, the block contains one or more internal voids. By this means, the mass of the diaphragm can be reduced.

Preferably, the one or more elongate members are in tension.

Preferably, the tension is a relatively low tension just sufficient to maintain the members taut at all times in use. Such a degree of tension is sufficient to allow proper bonding when it is desired that the one or more elongate members be bonded to the block of material.

Advantageously, the or each elongate member is constituted by a bundle of monofilaments.

Preferably, the monofilaments are plastics material monofilaments.

The monofilament material may be paraphenylene polybenzobisoxazole.

The one or more flexible elongate members may comprise glass fibre monofilaments.

The body of material may be bound about by a single flexible elongate member.

Preferably, the diaphragm is a diaphragm for sub-bass or bass or bass-mid audio frequencies. Such diaphragms are relatively large and not difficult to bound about with turns of the one or more flexible elongate members.

The body of material may be bound about by between 100 and 500 turns.

The body of material may be bound about by between 200 and 400 turns.

A protective rim may be provided at the periphery of the block between the one or more elongate members and the material of the block. Such a rim is particularly useful when the block of material is made of polystyrene and liable to be too easily penetrated at its periphery by the one or more elongate members bound about it.

The one or more elongate members may be adhesively secured directly to the material of said block. The stiffening composition may serve both to stiffen the one or more elongate members and to secure them to the material of the block.

Preferably, the said first face of the block of the material and said one or more flexible members are arranged to act directly on the ambient air to radiate sound. In such a construction, there is no additional skin to add unwanted mass to the diaphragm.

Advantageously, the diaphragm is bonded to a central tubular member for carrying the voice coil of the loudspeaker drive unit.

The stiffening composition may comprise a resin composition.

The resin composition may be selected from the group consisting of a styrene resin, an epoxy resin, a cellulose solvent based acrylic resin, a polyurethane resin, a cyanocrylate resin, and a thermosetting phenolic based resin.

The invention also provides a loudspeaker drive unit including a diaphragm as defined above.

The invention also provides a method of making a diaphragm for a loudspeaker drive unit, comprising binding a block of material with a multiplicity of turns of one or more elongate members of flexible material and using a stiffening composition to stiffen the one or more elongate members.

Figure 2:
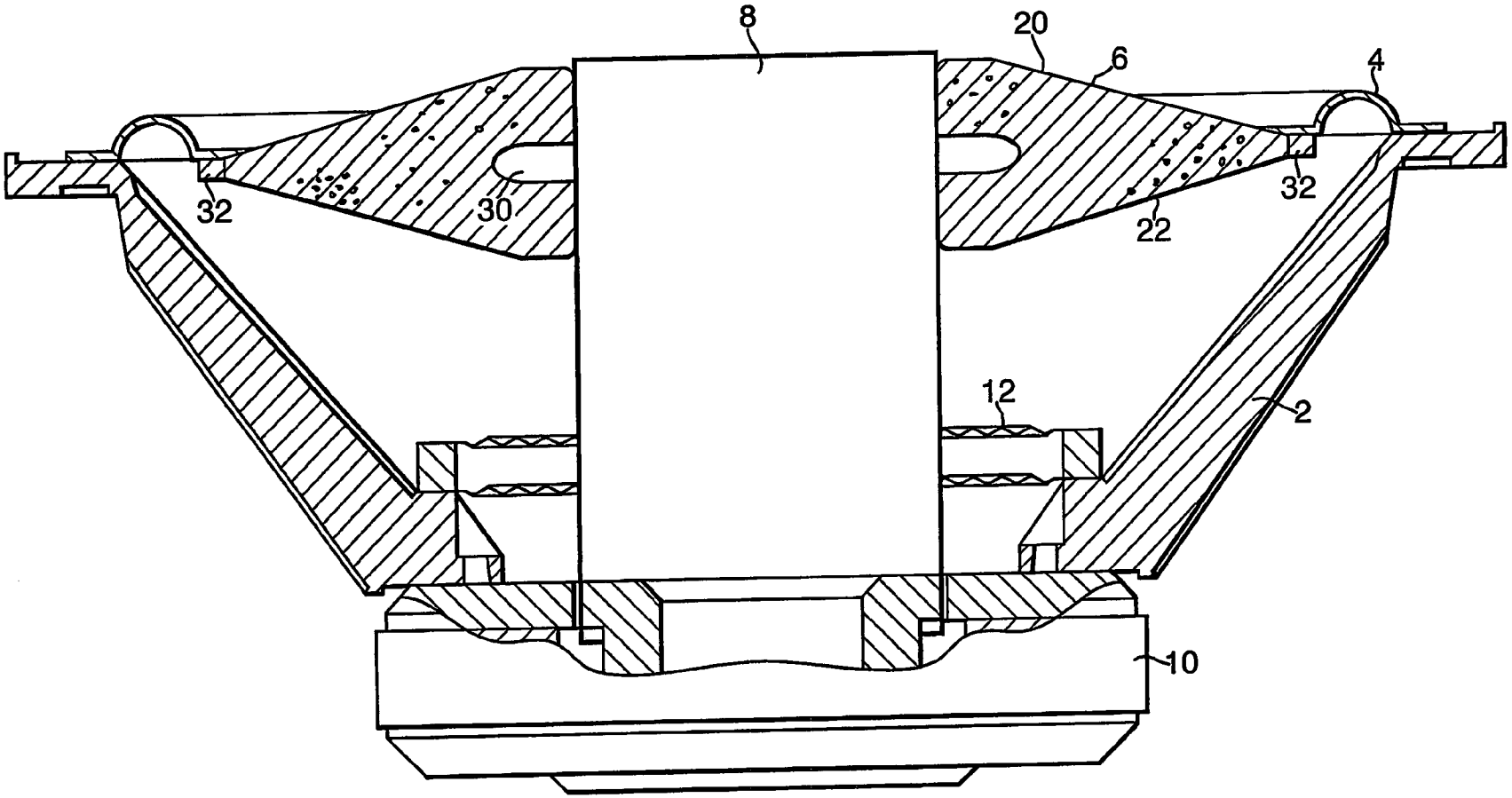
Figure 3:
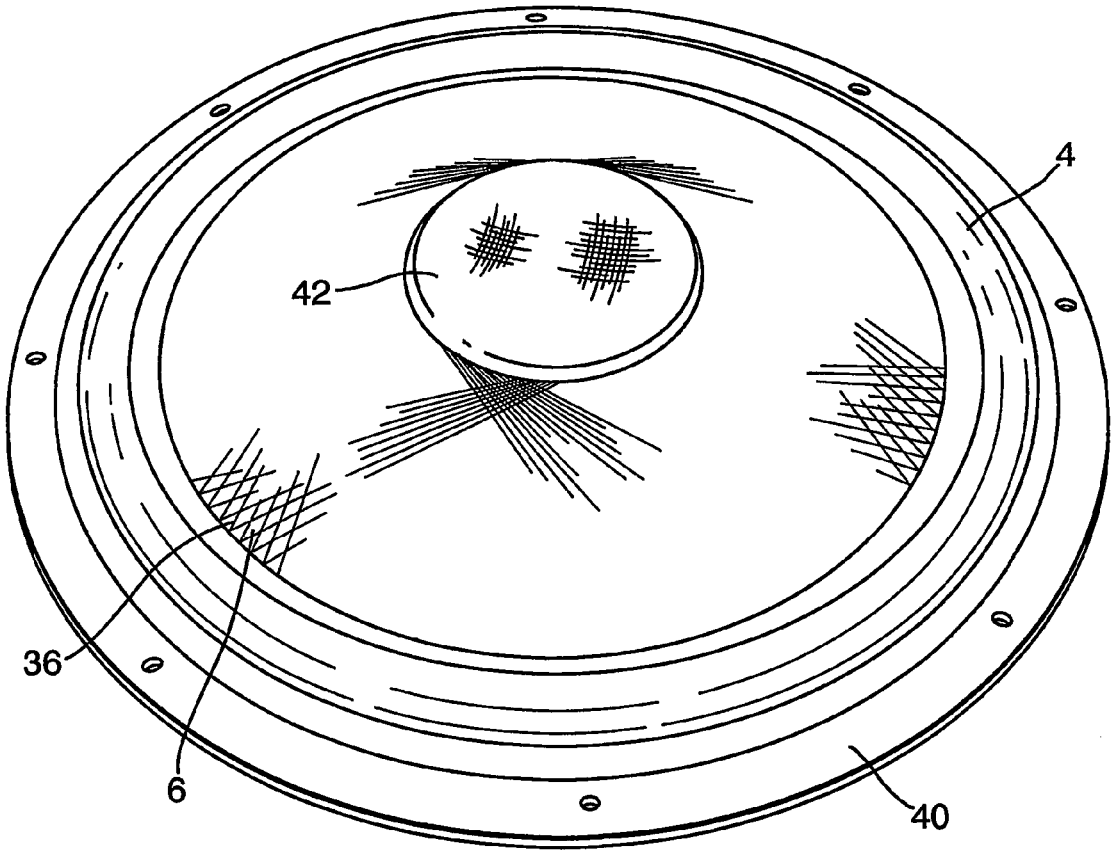

Diaphragms for a loudspeaker drive unit constructed in accordance with the invention will now be described, by way of example only, with reference to the accompanying drawings, in which:

FIG. 1 shows a diagrammatic cross-section through a loudspeaker drive unit including a diaphragm embodying the invention;

FIG. 2 corresponds to FIG. 1 but shows the provision of internal voids and a protective rim; and FIG. 3 is a perspective view of a diaphragm embodying the invention.

Referring to the accompanying drawings, FIG. 1 shows a loudspeaker drive unit 1 embodying the invention. The drive unit comprises a chassis member 2 carrying a diaphragm suspension or surround 4. The surround, in turn, carries the diaphragm 6 of the loudspeaker drive unit. A central tube 8 is provided within the diaphragm 6. The loudspeaker drive unit 1 has a magnet assembly 10 and a suspension or "spider" 12 for the inner end of the tube 8. A voice coil is provided at the inner end of the tube 8 within the magnet assembly 10 but is omitted from the drawings for ease of illustration.

The loudspeaker drive unit 1 is for the reproduction of sub-bass or bass or mid-bass audio frequencies.

The diaphragm 6 is a shallow convex, symmetrical, lightweight diaphragm whose inherent rigidity and internal losses serve well to attenuate delayed resonances from inside a loudspeaker enclosure. The tube 8 is a thin walled tube and can be either the loudspeaker voice coil former sleeve itself or can comprise an extension to a voice coil former sleeve.

Because of the presence of the tube 8 within the diaphragm 6, the diaphragm may be thought of as having a very low relative density centre and may be thought of as described by the volume occupied by two conical surfaces placed edge to edge punctured by an axial bore hole whose diameter corresponds to the outer diameter of the tubular former. The tube 8 is, as shown, bonded into the diaphragm, 6 so as to extend slightly beyond it.

In a practical example, the tube 8 was of a low density, high longitudinal stiffness material, in particular, tape-wound carbon fibre in an epoxy resin composite with density 1.6 grams/cc and Young's modulus 300 GPa.

The ratio of the outer diameter of the diaphragm 6 to the diameter of the tube 8 is preferably 3:1. Most practical constructions will lie between a ratio of 2:1 and a ratio of 6:1.

The ratio of the outer diameter of the diaphragm 6 to the overall thickness of the diaphragm is preferably 4:1. Most practical constructions will lie between a ratio of 3:1 and 10:1.

The diaphragm 6 comprises a block of material having a first, sound-radiating front face 20 and a second, rear face 22. The block is stiffened by being bound about over the first and second faces 20, 22 by a multiplicity of turns of an elongate member (not shown in FIGS. 1 and 2 for clarity of illustration) of flexible material and stiffened by a stiffening composition.

A single continuous fibre or tape is wound in contact with and at a tangent to the slightly projecting tube 8, around the outside edge of the diaphragm 6 and back to the diametrically and vertically opposed tangential face of the tube whilst a synchronised periodic rotation of the diaphragm about its central axis is performed. This operation is repeated for as many revolutions of the core as is required for an adequate covering of its surface. The method of winding is shown in FIG. 4 of patent specification WO 00/78091. About 300 turns are put on the diaphragm 6.

Stiffening is achieved by the addition of an adhesive resin to the fibre as it is wound over the diaphragm 6 and tube 8, or by application of adhesive resin to the diaphragm and tube before the fibre is wound, or by application of adhesive resin to the wound assembly of all three components by, for example, spraying. Such an adhesive resin can simply take the form of an automotive paint, for example, of an aesthetically pleasing colour. The following are all suitable compositions for use: a two part styrene resin, a part epoxy resin, a cellulose solvent based acrylic lacquer, a two part isocyanate reactable lacquer, a part epoxy reactable lacquer, a polyurethane lacquer, a cyanoacrylate, and a thermosetting phenolic based resin.

The front face 20 is convex and the second face 22 is also convex and the construction is symmetrical. The faces 20 and 22 are, as shown, frusto-conical. The diaphragm 6 is circular in front elevation.

The block of material constituting the diaphragm 6 is of a rigid plastics foam material. The foam is of a very low density, largely non-porous foamed material with a relatively high stiffness/mass ratio and high internal damping. Polymethyl methacrylamide foam with a density of 30 grams/liter is a suitable material, or, for reduced cost, a moulded expanded polystyrene foam form of density around 30 grams/liter can be used.

In one practical example of the invention, the foam material used was Rhoacell 31LS which has a density of 32 kg/m3 and a Young's modulus of 35 MPa. Rhoacell is available in different grades of different density and corresponding stiffness. For example, Rhoacell 51LS (density=52 kg/m3, YM=68 MPa) and Rhoacell 71LS (density=75 kg/m3, YM=90 MPa). The diaphragm was machined from a solid block, Rhoacell being easy to machine although expensive.

The flexible elongate member is in tension but the tension is a relatively low tension just sufficient to maintain the member taut at all times in use. The elongate member is constituted by a bundle of monofilaments of plastics material monofilaments. The elongate member is wound under sufficient tension to ensure that it remains taught over the whole structure, in this way, all the available stiffness of the fibre and the performance of the structure as a whole is substantially maximised. It is possible, however, to use a tension of a significantly higher to obtain a degree of pre-stressing in the same manner of a spoked wheel.

The elongate member is in contact with the foam core and/or the tubular former at all times.

In one practical example, the elongate member was a low density yet very high stiffness material with high internal damping, in particular, monofilamentary paraphenylene polybenzobisoxazole (PBO) Zylon HM tow with a density of 1.56 grams/cc and a Young's modulus of 270 GPa. The lack of wastage in the construction and the relatively small amount of material required almost removes the need for any cheaper option but glass fibre of density 2.7 g/cc and modulus 71 GPa can produce acceptable results in some applications.

Preferably, the fibres of the elongate member are not only stiffened but are bonded to each other and the diaphragm 6 and the tube 8.

In one practical example, the ratio of masses of the three components tube 8, diaphragm 6 and elongate member was 2:16:1. Most practical constructions will lie within the ranges of the tube 8 being twice as heavy or half as light, or the elongate member being four times as heavy or half as light, both with respect to the diaphragm 6.

In one practical example, the diaphragm 6 had a 300 mm outer diameter and the tube 8 a 100 mm diameter. The elongate member had a diameter of about 0.07 mm and about 300 turns were applied.

The illustrated construction has the advantage that binding the diaphragm with the elongate member is able to shift the first break-up frequency of the diaphragm from 1500 Hz to 2500 Hz.

A modified embodiment of the invention is shown in FIG. 2 in which identical reference numerals are used for identical parts. Only the differences from the embodiment of FIG. 1 will be described. In FIG. 2, the diaphragm 6 includes an annular internal void 30 to reduce its mass. A circumferential protective rim 32 in the form of a ring of filament-wound carbon fibre surrounds the periphery of the block of material constituting the diaphragm 6 and underlies the binding by the elongate member. The protective rim and internal void may be used independently as well as in conjunction with each other as illustrated.

FIG. 3 shows a practical example of a diaphragm embodying the invention. The diaphragm of FIG. 3 has an outer, metal mounting flange attached to the periphery of the surround 4 and a central dust cap 42, for example, of woven carbon fibre is provided over the mouth of the tube 8. The elongate member bound about the diaphragm 6 is clearly to be seen as reference 36.

Instead of the dust cap shown in FIG. 3, it is possible to provide a cylindrical plug of the foam material within the interior of the tube 8.

The illustrated embodiments of the invention match the excellent axial mode performance of existing simple cone designs within similar overall dimensions, whilst addressing many of their limitations at a potentially modest cost involving only a simple construction technique and little requirement for pre-processing of materials. The very small wastage in production and efficient use of materials allows greater use of more advanced components, in particular, the use of advanced, high modulus fibres.

Alternative materials which can be used for the diaphragm 6 include Klegecell, Divinycell and Corecell, all of which are cheaper than Rhoacell but more difficult to machine.

Polystyrene is a very cheap alternative which can be injected moulded to form the desired shape for the diaphragm.

The diaphragm can, in fact, be made of virtually any suitable lightweight material, for example, aluminium honeycomb, aramid honeycomb, metallic or ceramic foams, aerogels, syntactics, polymer moulded honeycombs or core structures, dimpled sheets, corrugated cardboard, glass microsphere composites, endgrain or laminated balsa wood.

If desired, a thin membrane can be used to seal the block of material and a gas, other than air can be incorporated within the sealed block to improve the isolation from the inside to the outside of the enclosure when the diaphragm is in use. Instead, by some form of pre-stressing of the bound diaphragm a vacuum can be sustained within it to provide the best acoustic isolation.

The elongate member can take the form of a monofilament, yarn tow, wire, tape or ribbon and be of virtually any material. Cotton, silk, liquid crystal polymer, boron, shape memory metal, aramids and tungsten filaments can all be used.

The block of material used in the diaphragm may be a single block of integral construction or may be made form two or more smaller blocks joined together into a single block.

The invention is also applicable to a dome type speaker in which the tube carrying the voice coil is connected to the outside of the diaphragm.

In a construction using a central voice coil tube, it is possible to dispense with a tube that penetrates the diaphragm and instead replace it by one which is bonded directly to the bottom of the inside edge of the diaphragm's central hole. The extra reinforcement to the strength of the diaphragm core that the illustrated construction imparts can be replaced or even exceeded by changing the winding technique to toroidal winding. Thus, a single continuous fibre can be wound down through the axial bore and over the diaphragm continuously until the whole structure is covered.

In the illustrated embodiments, the elongate member is wound so that it is a tangent to the tube. This results in a distribution over the surface with greater fibre density, in terms of unit area, closer to the tube than towards the outer edge of the diaphragm. By altering the angle the fibre makes with the tube a more uniform fibre distribution as regards to structural stiffness is possible.

Other suitable materials for the one or more elongate members are carbon fibre and Kevlar®.

The invention claimed is:

1. A diaphragm for a loudspeaker drive unit, the diaphragm comprising a block of rigid plastic foam material having a first, convex, frusto-conical sound-radiating front face and a second, convex, frusto-conical rear face, each said frusto-conical face being formed by a respective frustum comprising a truncation plane and surrounding conical flank, wherein said block is stiffened by being bound about over said first and second faces by a multiplicity of turns of one or more elongate members of flexible material stiffened by a stiffening composition, said flexible material being wound tangentially to said truncation planes so as to leave interstitial spaces between adjacent turns at the outer periphery of said conical flanks, in which spaces said block of rigid plastic foam material is left uncovered by said elongate members, wherein said one or more elongate members are disposed in low tension so as to maintain said elongate members taut without pre-stressing the same, wherein said one or more elongate members comprise tape wound carbon fibers and said stiffening composition comprises an epoxy resin.

2. A diaphragm as claimed in claim 1, wherein the foam is a foam selected from the group consisting of polymethyl methacrylamide foam, and expanded polystyrene foam.

3. A diaphragm as claimed in claim 1, wherein the block is made of a rigid plastic foam material having a density selected from the group consisting of more than 20 grams per liter, and between 28 and 35 grams per liter.

4. A diaphragm as claimed in claim 1, wherein the block contains one or more internal voids.

5. A diaphragm as claimed in claim 1, wherein the or each elongate member is constituted by a member selected from the group consisting of a bundle of monofilaments, a bundle of plastic material monofilaments, a bundle of paraphenylene polybenzobisoxazole monofilaments, and a bundle of glass fiber monofilaments.

6. A diaphragm as claimed in claim 1, wherein a protective rim is provided at the periphery of the block between the one or more elongate members and the material of the block.

7. A diaphragm for a loudspeaker drive unit, the diaphragm comprising a block of rigid plastic foam material containing one or more internal voids, said block having a first, sound-radiating front face and a second, rear face, and a multiplicity of turns of one or more elongate members of flexible material stiffened by a stiffening composition bound about tangentially over the first and second faces so as to stiffen said block, spaces being left between said turns at the periphery of said block, wherein said one or more elongate members are disposed in low tension so as to maintain said elongate members taut without pre-stressing the same.

8. A diaphragm as claimed in claim 7, wherein the one or more elongate members are adhesively secured directly to the material of said block.

9. A diaphragm as claimed in claim 7, wherein the diaphragm is bonded to a central tubular member for carrying the voice coil of the loudspeaker drive unit.

10. A diaphragm as claimed in claim 7, wherein the foam is a foam selected from the group consisting of polymethyl methacrylamide foam, and expanded polystyrene foam.

11. A diaphragm as claimed in claim 7, wherein the stiffening composition comprises a composition selected from the group consisting of a resin composition, a styrene resin, an epoxy resin, a cellulose solvent based acrylic resin, a polyurethane resin, a cyanocrylate resin, and a thermosetting phenolic based resin.

12. A diaphragm as claimed in claim 7, wherein the block is made of a rigid plastic foam material having a density selected from the group consisting of more than 20 grams per liter, between 20 and 35 grams per liter, and between 28 and 35 grams per liter.

13. A diaphragm as claimed in claim 7, wherein the or each elongate member is constituted by a member selected from the group consisting of a bundle of monofilaments, a bundle of plastics material monofilaments, a bundle of paraphenylene polybenzobisoxazole monofilaments, and a bundle of glass fiber monofilaments.

14. A diaphragm for a loudspeaker drive unit, the diaphragm comprising a block of rigid plastic foam material, said block having a first, sound-radiating convex front face, a central tubular member for carrying the voice coil of said loudspeaker drive unit, said block being bonded to said central tubular member, and a multiplicity of turns of one or more elongate members of flexible material stiffened by a stiffening composition wound tangentially to said central tubular member over the first and second faces so as to stiffen said central tubular member and said block, wherein said block has a diameter of about 300 mm and said number of turns is between 100 and 500, and wherein said one or more elongate members of flexible material comprise tape wound carbon fibers and said stiffening composition comprises an epoxy resin such that said central tubular member has a high longitudinal stiffness.

15. A diaphragm as claimed in claim 14, wherein the body of material is bound about by a number of turns selected from the group between 100 and 500 turns, between 100 and 400 turns, between 200 and 400 turns, and approximately 300 turns.

16. A diaphragm as claimed in claim 14, wherein said first face of the block of the material and said one or more flexible members are arranged to act directly on the ambient air to radiate sound.

17. A diaphragm as claimed in claim 14, wherein the block contains one or more internal voids.

18. A diaphragm as claimed in claim 14, wherein a protective rim is provided at the periphery of the block between the one or more elongate members and the material of the block.

19. A diaphragm as claimed in claim 14, wherein the winding has less than 400 turns.

20. A diaphragm as claimed in claim 14, wherein said tape wound carbon fibers stiffened by said epoxy resin have a Young's modulus of approximately 300 GPa.

21. A diaphragm for a loudspeaker drive unit, the diaphragm comprising:

a central tubular member, a circular block of rigid foam material of lozenge-shaped cross-section surrounding said tubular member and secured thereto, said block having a first sound-radiating front face and a second, rear face and having a density between 25 and 35 grams per liter, a winding consisting of between 100 and 500 turns of a flexible monofilaments bundle of paraphenylene polybenzobisoxazole wound tangentially to said tubular member about said block to form a single layer at the periphery of said block leaving spaces between turns, and an adhesive stiffening composition applied to said monofilament bundle, said adhesive stiffening composition securing said winding to said block of rigid foam material and securing said block of rigid foam material to said central tubular member.

22. A diaphragm as claimed in claim 21, wherein the mass of said block is about 16 times the mass of said winding.

23. A diaphragm as claimed in claim 21, wherein the winding has less than 400 turns.

* * * * *